US006717496B2

(12) United States Patent
Feng et al.

(10) Patent No.: US 6,717,496 B2
(45) Date of Patent: Apr. 6, 2004

(54) ELECTROMAGNETIC ENERGY CONTROLLED LOW ACTUATION VOLTAGE MICROELECTROMECHANICAL SWITCH

(75) Inventors: Milton Feng, Champaign, IL (US); Shyh-Chiang Shen, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 104 days.

(21) Appl. No.: 10/008,188

(22) Filed: Nov. 13, 2001

(65) Prior Publication Data

US 2003/0090350 A1 May 15, 2003

(51) Int. Cl.[7] ..... H01H 51/34

(52) U.S. Cl. ..... 335/78; 200/181
(58) Field of Search ..... 335/78–86; 200/181

(56) References Cited

U.S. PATENT DOCUMENTS

| | | | | |
|---|---|---|---|---|
| 4,959,515 | A | 9/1990 | Zavracky et al. | |
| 5,168,249 | A | 12/1992 | Larson | |
| 5,258,591 | A | 11/1993 | Buck | |
| 5,677,823 | A | 10/1997 | Smith | |
| 5,929,497 | A | 7/1999 | Chavan et al. | |
| 6,046,659 | A | 4/2000 | Loo et al. | |
| 6,091,050 | A | 7/2000 | Carr | |
| 6,100,477 | A | 8/2000 | Randall et al. | |
| 6,143,997 | A | 11/2000 | Feng et al. | |
| 6,310,339 | B1 * | 10/2001 | Hsu et al. | 250/214.1 |
| 6,380,600 | B1 * | 4/2002 | Alping et al. | 257/415 |
| 6,384,353 | B1 * | 5/2002 | Huang et al. | 200/181 |
| 6,469,603 | B1 * | 10/2002 | Ruan et al. | 335/78 |
| 2002/0050882 | A1 * | 5/2002 | Hyman et al. | 335/78 |
| 2002/0176649 | A1 * | 11/2002 | Bao et al. | 385/16 |
| 2003/0080839 | A1 * | 5/2003 | Wong | 335/78 |
| 2003/0107460 | A1 * | 6/2003 | Huang | 335/78 |

OTHER PUBLICATIONS

C.L. Goldsmith, Zhimin Yao, Susan Eshelman, and David Denniston, "Performance of Low–Loss RF MEMS Capacitive Switches" *IEEE Microwave and Guides Wave Letters*, vol. 8, No. 8, Aug. 1988, pp. 269–271.

N. Scott Barker, Gabriel M. Rebeiz, "Distributed MEMS True–Time Delay Phase Shifters and Wide–Bank Switches", *IEEE Transactions on Microwave Theory and Techniques*, vol. 46, No. 11, Nov. 1988, pp. 1881–1890.

Elliot R. Brown, "RF–MEMS Switches for Reconfigurable Integrated Circuits", *IEEE Transactions on Microwave Theory and Techniques*, vol. 46, No. 11, Nov. 1998, pp. 1868–1880.

J. Jason Yao, M. Frank Chang, "A Surface Micromachined Miniature Switch for Telecommunications Applications with Signal Frequencies from DC up to 4 GHZ", IEEE conference paper, 1995.

(List continued on next page.)

*Primary Examiner*—Tuyen T. Nguyen
*Assistant Examiner*—Bernard Rojas
(74) *Attorney, Agent, or Firm*—Greer, Burns & Crain, Ltd.

(57) ABSTRACT

The present invention is an electromagnetic energy, e.g., visible light, controlled low actuation voltage MEMS switch. Stimulation of photovoltaic diodes causes a switching that controls the flow of a signal. A metal or other suitable conductive pad moves freely up and down within brackets, without the need for deformation, in response to the diodes to either ground a signal or permit it to pass. The low activation voltage of the bracketed pad structure permits the use of a reasonable number of photovoltaic diodes to develop sufficient voltage for actuation of the switch, allowing the realization of the present electromagnetic energy, e.g., visible light, controlled MEMS switch in a minimized chip area. The photovoltaic diodes do not require an independent DC power source to operate the switch of the invention. Use of different wavelengths to excite different sets of diodes allows turning on and off of the switch of the invention.

14 Claims, 10 Drawing Sheets

OTHER PUBLICATIONS

Chuck Goldsmith, Tsen–Hwang Lin, Bill Powers, WenRong Wu, Bill Norvell, "Micromechancial Membrane Switches for Microwave Applications", *IEEE MTT–S Digest*, 1995, pp. 91–94.

C. Goldsmith Z. Yao, S. Eshelman, D. Denniston, S. Chen, J. Ehmke, A. Malczewski, R. Richards, "Micromachining of RF Devices for Microwave Applications", Raytheon TI Systems Materials.

J. Jason Yao, Sang Tae Park, and Jeffrey DeNatale, "High Tuning–Ratio MEMS–Based Tunable Capacitors for RF Communications Applications", Solid State Sensor and Actuator Workshop, Hilton Head Island, South Carolina, Jun. 8, 1998.

J.L. Ebel, A.P. Walker, R.E. Strawser, R. Cortez, K.D. Leedy, G.C. DeSalvo, "Investigation of MEMS RF switches for low loss phase shifters", GOMAC 2001 Digest of Papers, pp. 87–89, Mar. 2001.

C. Goldsmith, J. Ehmke, A. Malczewski, B. Pillans, S. Eshelman, Z. Yao, J. Brank, and M. Eberly, "Lifetime characterization of capacitative RF MEMS switches", IEEE MTT–S 2001 International Microwave Symposium Digest, pp. 227–230, May 2001.

* cited by examiner

| DEVICE PARAMETER | | PRESENT DIMENSION | MINIMUM POSSIBLE DIMENSION | MAXIMUM POSSIBLE DIMENSION | COMMENTS |
|---|---|---|---|---|---|
| WIDTH (μm) | SWITCH | 100, 150 | 0.1 | 1000 | NOT NECESSARILY RECTANGULAR IN SHAPE |
| | ELECTRODE | 100, 150 | 0.1 | 1000 | |
| LENGTH (μm) | SWITCH | 450 | 2 | 1000 | |
| | ELECTRODE | 200, 150, 100, 50 | 2 | 1000 | |
| DIELECTRIC LAYER THICKNESS (μm) | | 0 | 0 | 30 | |
| CLEARANCE BETWEEN TOP AND BOTTOM ELECTRODES (μm) | | 4 | 1 | 1000 | |

FIG. 6A

| | CANTILEVER (ROCKWELL) | MEMBRANE (TT) | HINGE TYPE (UIUC) |
|---|---|---|---|
| FREQUENCY (GHz) | 4 | 20 ~ 35 | 50 |
| RON (Ω) | N/A | 0.35 | 0.3 |
| COFF (pF) | N/A | 35 | 30 |
| CUTOFF FREQUENCY (GHz) | N/A | > 9000 | > 10,000 |
| INSERTION LOSS (dB) | 0.1 | 0.14 ~ 0.17 | 0.2 |
| ISOLATION (dB) | 50 | 24 ~ 35 | 30 |
| CAPACITANCE RATIO | N/A | 80 ~ 110 | ~ 100 |
| SWITCHING SPEED (μS) | 30 | < 2 | 2 |
| SWITCHING VOLTAGE (V) | 28 | 30 ~ 50 | < 3 |
| SIZE ($\mu m^2$) | (200 X 200) X 2 | 280 X 170 | 450 X 100<br>450 X 150 |

FIG. 7

ELECTROMAGNETIC ENERGY CONTROLLED LOW ACTUATION VOLTAGE MICROELECTROMECHANICAL SWITCH

REFERENCE TO RELATED APPLICATION

This application is related to the subject matter of previous application Ser. No. 09/326,771 to Milton Feng and Shyh-Chiang Shen, filed Jun. 4, 1999, now U.S. Pat. No. 6,143,997, issued Nov. 7, 2000.

STATEMENT OF GOVERNMENT INTEREST

This invention was made with Government support under Contract No. F33615-99-C-1519 awarded by the United States Defense Advanced Research Projects Agency (DARPA)." The Government has certain fights in the invention.

FIELD OF THE INVENTION

The present invention generally concerns switches. More specifically, the present invention concerns microelectromechanical switches.

BACKGROUND OF THE INVENTION

Switching operations are a fundamental part of many electrical, mechanical, and electromechanical applications. Microelectromechanical systems (MEMS) for switching applications have drawn much interest, especially within the last few years. Products using MEMS technology are widespread in biomedical, aerospace, and communication systems. Recently, the MEMS applications for radio frequency (RF) communication systems have gained even more attention because of the MEMS's superior characteristics. RF MEMS have advantages over traditional active-device-based communication systems due to their low insertion loss, high linearity, and broad bandwidth performance.

SUMMARY OF THE INVENTION

The present invention is an electromagnetic energy, e.g., visible light, controlled low actuation voltage MEMS switch. Stimulation of photovoltaic diodes causes a switching that controls the flow of a signal. A metal or other suitable conductive pad moves freely up and down within brackets, without the need for deformation, in response to the diodes to either ground a signal or permit it to pass. The low activation voltage of the bracketed pad structure permits the use of a reasonable number of photovoltaic diodes to develop sufficient voltage for actuation of the switch, allowing the realization of the present electromagnetic energy, e.g., visible light, controlled MEMS switch in a minimized chip area. The photovoltaic diodes do not require an independent DC power source to operate the switch of the invention. Use of different wavelengths to excite different sets of diodes allows turning on and off of the switch of the invention.

In a preferred embodiment, the conductive pad electrically grounds a signal when the pad is located in a relaxed position (contacts closed). The pad is oriented for gravity to hold it in the relaxed position, but a voltage may assist the position and should be used where gravity or another force will not assist the contacts. Electromagnetic energy, e.g., visible light, stimulation through photovoltaic diodes provides a voltage to allow the signal to pass when a voltage serves to locate the pad in a stimulated position (contacts open). Voltage from the photovoltaic diodes are provided to electrodes that move the pad up and down with a low actuation voltage compared to known devices. The pad is not bent by the actuation voltage.

BRIEF DESCRIPTION OF THE DRAWINGS

Other features and advantages of the invention will be apparent to those skilled in the art with reference to the detailed description and the drawings, of which:

FIG. 6A is a table of possible dimensions for the switch of the present invention;

FIG. 7 is a table comparing the capabilities of known switches with the RF MEMS switch of the present invention.

TABLE OF ACRONYMS

This patent utilizes several acronyms. The following table is provided to aid the reader in understanding the acronyms:

C=Centigrade.

DC=direct current.

MEMS=microelectromechanical system.

MMIC=Monolithic Microwave Integrated Circuit.

PECVD=Plasma-Enhanced Chemical vapor deposition.

RF=radio frequency.

DETAILED DESCRIPTION OF THE PREFERRED EMBODIMENTS

Generally, the present invention is an apparatus and method for controlling the flow of signals through electromagnetic energy, e.g., visible light, activation. More specifically, the method and apparatus is an electromagnetic energy, e.g., visible light, activated MEMS switch which is easy to produce and does not rely on the deformation of at least part of the system to complete an electrical connection of the switch. The switch is activated with a low voltage supplied by photovoltaic diodes.

Figure 1A:
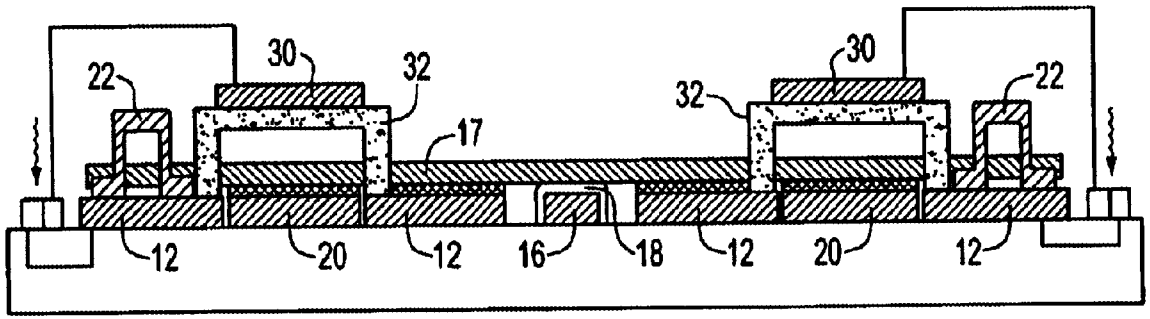
FIG. 1A is a schematic cross-sectional side view of a preferred embodiment of a switch of the present invention in a pad down (contacts closed) position.
Figure 1B:
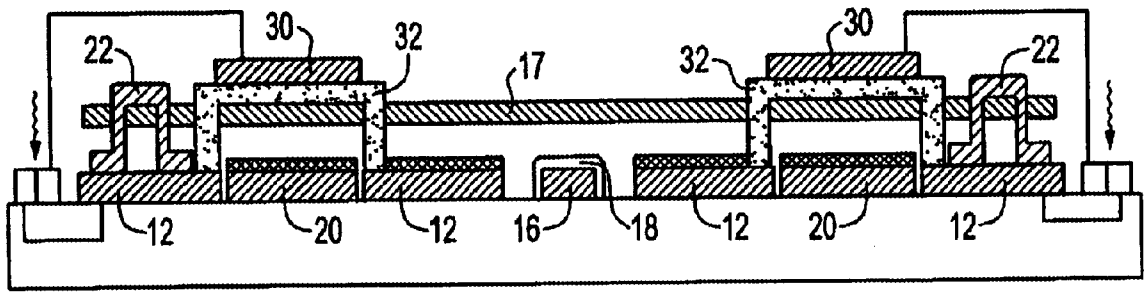
FIG. 1B is the same side view as FIG. 1A in a pad up (contacts open) position.

Referring now to the drawings, and particularly FIGS. 1A and 1B, a preferred embodiment switch of the present invention includes a substrate base 10. Any type of substrate used in semiconductor fabrication can be applied to the present invention such as silicon, GaAs, InP, GaN, sapphire, quartz, glasses, and polymers. Upon the substrate base 10 are waveguides which include one or more ground planes 12 and a signal line 16. Any form of contacts used in integrated circuits can be used with the present invention, such as coplanar waveguides and microstrip waveguides. For purposes of describing the invention, coplanar waveguides are shown.

The ground planes 12 pass signals, for example RF signals, from the signal line 16 to ground when the switch is in a relaxed (contacts closed) position, to produce an off state. While the present invention is described with regard to RF signals, it should be appreciated that other signals can be used, including low frequencies, millimeter-wave frequencies, and sub-millimeter-wave frequencies. The invention can be used for broad-band switching applications. To pass RF signals to ground, a conductive pad 17 is moveably positioned to contact both the signal line 16 and the ground planes 12 when the pad is in the relaxed position (FIG. 1A). The pad 17 is preferably made of metal, but can be made of any other suitable material. As shown with arrows, the input RF signal enters from an input port 16*a* (shown best in FIGS. 2–4), flows through the pad 17, and then flows to ground by the ground planes 12. Therefore, no RF signal flows through the output port 16*b* and the switch exists in an off state. Thus, unlike known MEMS, an off state occurs when the metal pad 17 is in a relaxed (contacts closed) position.

Preferably, a thin dielectric layer 18 is positioned between the signal line 16 and the metal pad 17 to serve as a DC blocking capacitor. A zero dielectric thickness corresponds to a physical short in the switch. A non-zero dielectric thickness corresponds to a capacitively coupled shunt switch, i.e., effectively a low-pass filter or an RF short. Any type of dielectric material can be applied, such as silicon dioxide, silicon nitride, pyralene, polymers, glasses and the like. In addition, bottom electrodes 20 can be inserted between the pad 17 and ground planes 12, to enhance contact by attracting the pad 17 towards the waveguides.

Figure 2A:
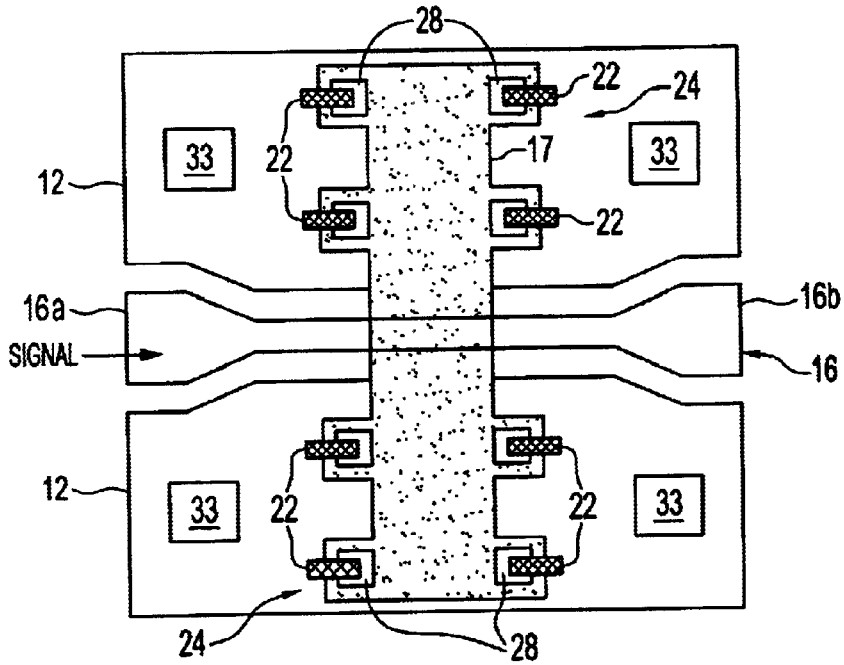
FIG. 2A is a schematic top view showing hinge brackets of the present invention located on sides of a conductive pad.
Figure 2B:
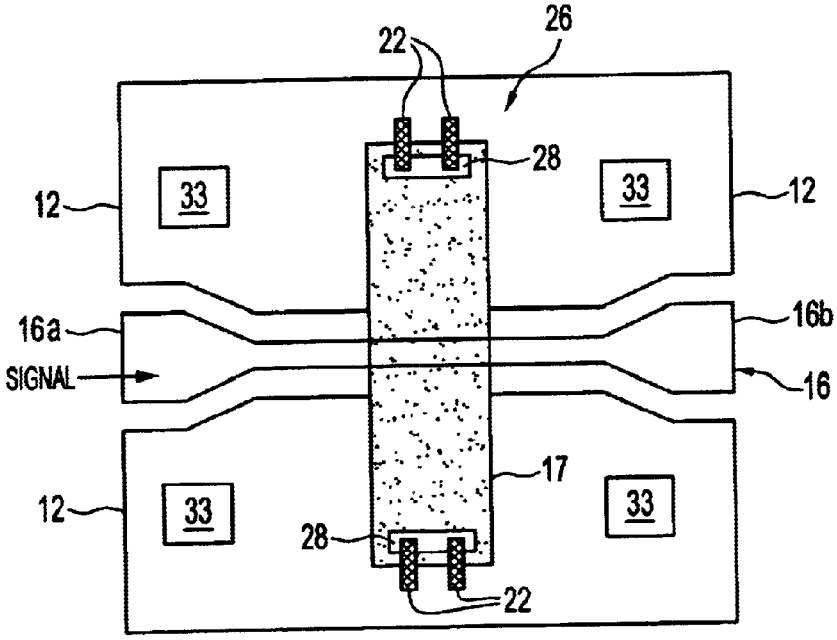
FIG. 2B is a schematic top view showing hinge brackets of the present invention located on the ends of the conductive pad.

Importantly, the pad 17 moves up and down freely with only the forces of gravity and air resistance to keep the metal pad 17 down. To guide movement of the pad 17, the pad 17 is slidably positioned with brackets 22. Preferably, the brackets 22 are placed atop the ground planes 12, and may be placed on any side of the metal pad 17. Referring to FIGS. 2A and 2*b*, brackets 22 are placed on sides 24 of the metal pad in FIG. 2A, and at ends 26 of the pad in FIG. 2*b*. As shown, each bracket 22 fits within an access hole 28 formed in the pad 17, to capture the pad 17 while allowing it to freely slide between its relaxed and excited positions.

Figure 3:
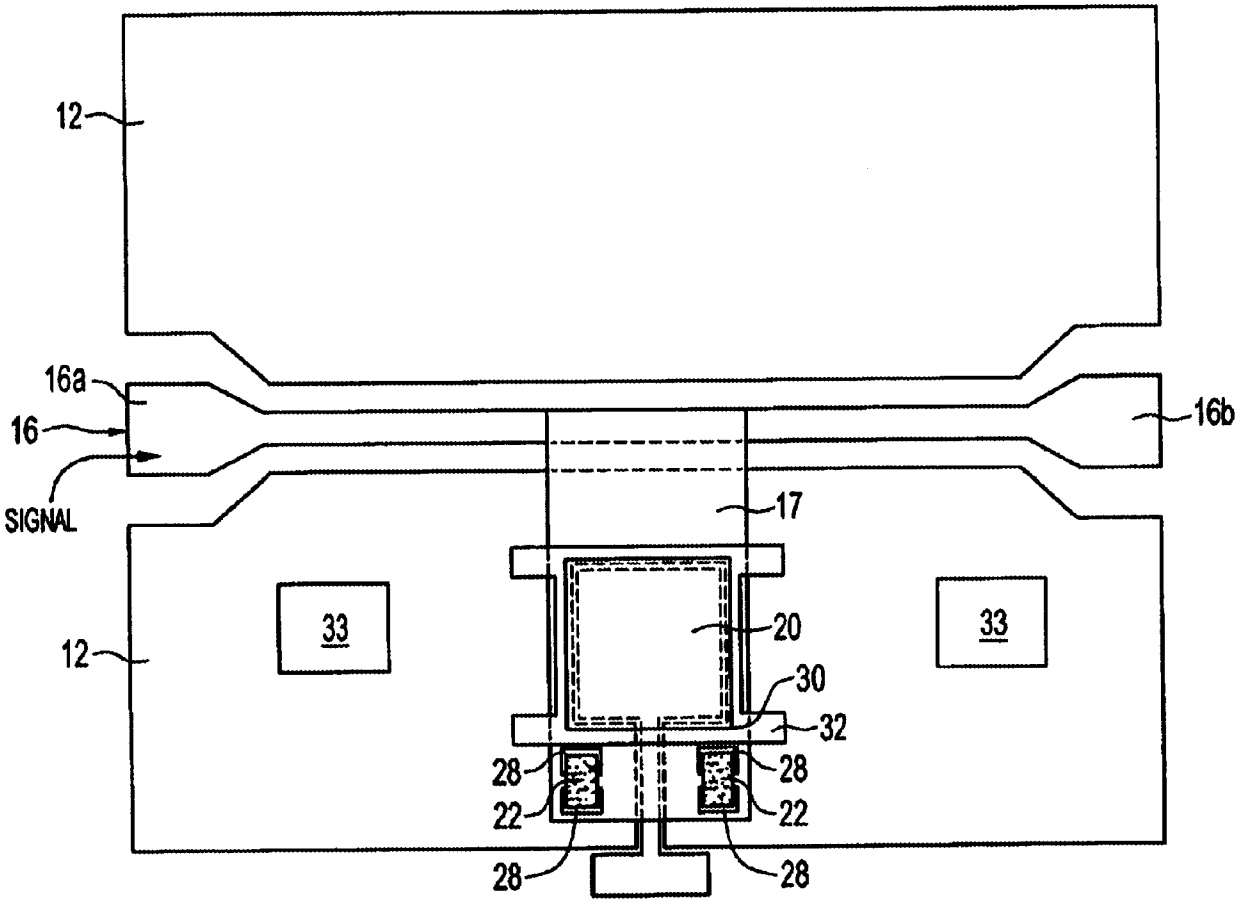
FIG. 3 is a schematic top view of an alternate embodiment of the hinge brackets of the present invention.

FIG. 3 shows a device which is similar to the device of FIGS. 1A and 1B, but is one-sided. One or more brackets 22 can be fabricated within one or two access openings 28 formed on one end of the pad 17. Preferably, when two brackets and openings are used, as in FIG. 3, spacing between access holes is equal to or less than 25 $\mu$m. For the hinge type switch of the present invention, two sacrificial layers each having a thickness of around 2 $\mu$m are used. To remove the layers successfully, spacing between openings should be less than 15 $\mu$m in all directions. It can be appreciated that the brackets 22 are designed with consideration given to a sacrificial layer removal capability and mechanical strength. Thus, the layer should be robust enough to contain the pad 17 while maintaining its physical integrity as the pad moves up and down, yet be easily removed by etching during a masking process described below.

Figure 4A:
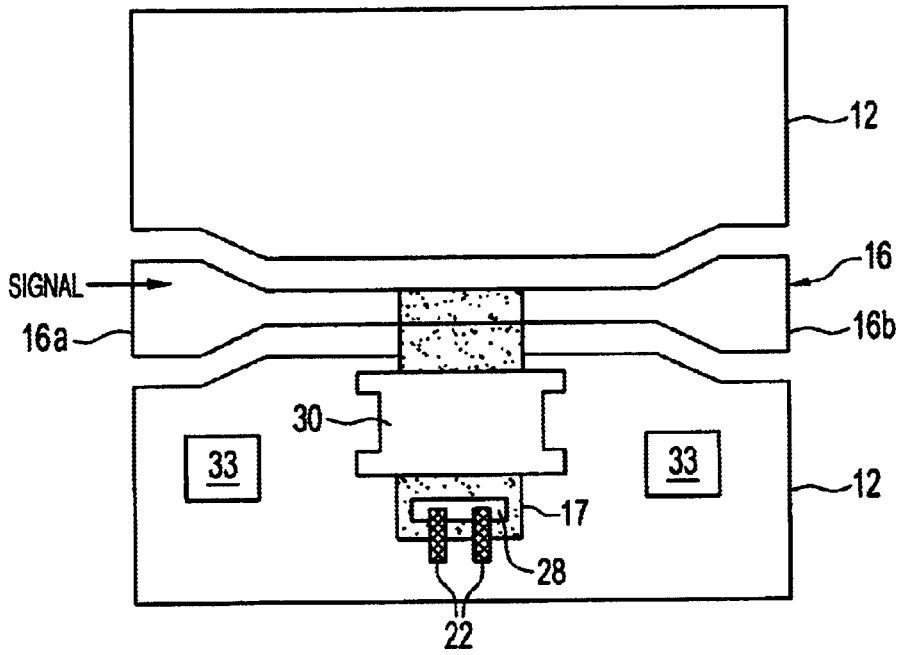
FIGS. 4A and 4B are schematic top views respectively showing one-sided and two-sided hinge structures of the present invention.
Figure 4B:
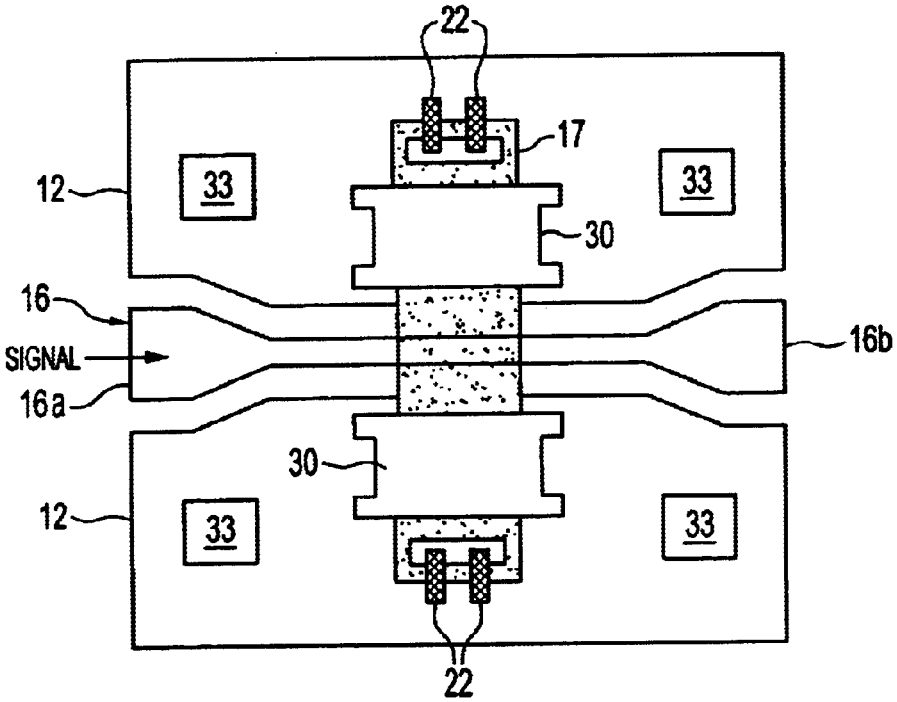

Referring now to FIGS. 4A and 4B, bracket structures which secure the conductive pad 17 through a single opening 28 are shown applied to a one sided switch (FIG. 4A) and a two sided switch (FIG. 4B).

Referring again to FIGS. 1A and 1B, the switch system includes top electrodes 30 which sit atop dielectric suspensions 32. Any suitable type of dielectric material can be used as the dielectric suspensions such as silicon dioxide, silicon nitride, pyralene, polymers, and glasses. Preferably, the dielectric suspensions 32 are positioned on the ground planes 12. Actuation voltage is applied alternately to the top electrode 30 and bottom electrode 20, or the top electrode 30 and ground as illustrated schematically, from photovoltaic sources 33 to provide electrostatic force that causes the metal pad to move, preferably in an up and down direction. It should be appreciated, however, that an operation of the switch does not depend on the metal pad moving in the up and down direction. Since the minimum required electrostatic forces produced by the actuation voltage is approximately equal to the sum of the gravitation and the air friction forces on the pad 17, the applied voltage is much less than that necessary for the cantilever and membrane structures described above. Thus, a small actuation voltage, e.g., less than 3 Volts, for RF MEMS devices is achieved.

Such voltage is easily developed by photovoltaic sources 33. In the figures, excepting FIGS. 5A–5K, the photovoltaic sources are represented schematically with respect to their positions and connections. Artisans will appreciate the particular form and connection scheme may change. Presuming a photovoltaic diode that develops 1 V, a cascaded arrangement of 5 diodes provides 5V. A number of diodes sufficient to power the top electrodes 30 is used to raise the pad 17, and a separate set is preferably used to hold the pad down. Thus, the switch can be actuated without any wired connections by making it respond to electromagnetic energy, e.g., visible light, signals. Independent sets of photovoltaic diodes are preferably filtered to respond to different light wavelengths, such that the diodes connected to the bottom electrodes 20 will respond to different excitation wavelengths than diodes connected to the top electrodes 30.

The conductive pad 17 is attracted upward when a small voltage, e.g., less than 3 Volts, is applied to top electrodes 30 (FIG. 1B) as a result of excitation of one set of diodes among the photovoltaic source 33. A clearance between the bottom electrodes 20 and the top electrodes 30 affects the necessary actuation voltage such that a larger clearance necessitates a greater actuation voltage. When the pad 17 is in the excited position (contacts open), RF signals flow unimpeded from the input port 16*a* to the output port 16*b* through signal line 16, as shown by the arrows, with only a negligible loss to the signal. In a preferred embodiment, this position corresponds to the switch "on" state. Thus, unlike known switches, the present switch is on when electrical contact is disengaged. In addition, since the actuation voltage is small, the present invention operates in either a normally "on" or in a normally "off" mode by applying DC voltage to either side of an actuation pad. The switching operation can be realized by applying two out-of-phase pulses at the top and bottom actuation electrodes through excitation of sets of diodes in the photovoltaic sources 33.

Figure 5A:
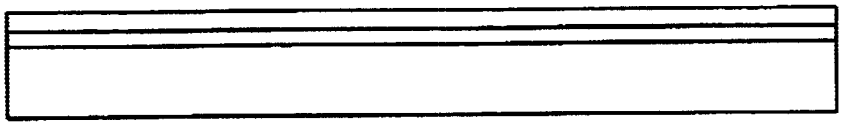
FIGS. 5A–5K are side views showing a process for manufacturing a preferred embodiment switch of the present invention.
Figure 5B:
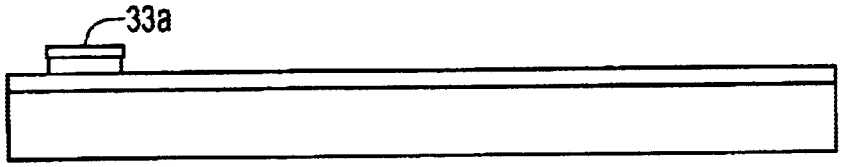
Figure 5C:
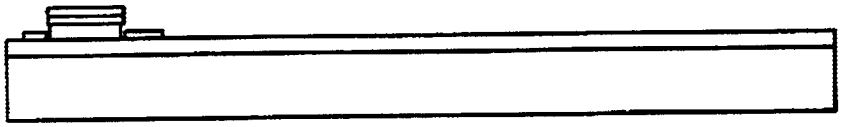
Figure 5D:
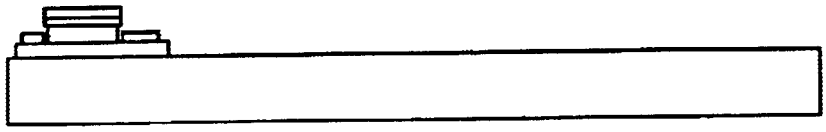
Figure 5E:
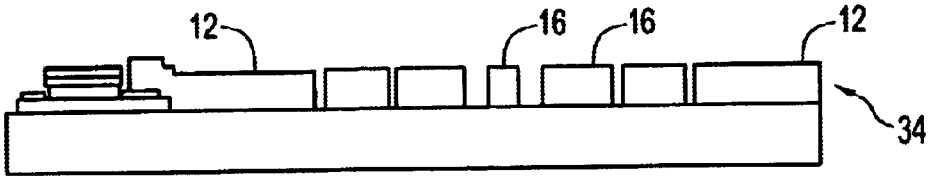
Figure 5F:
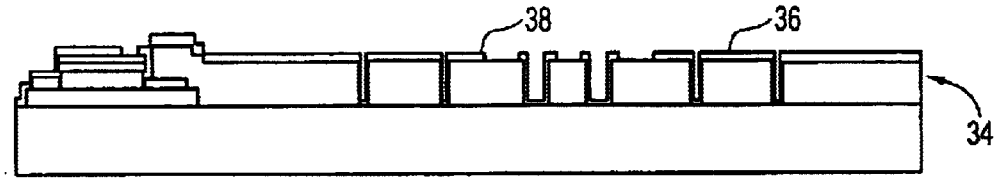

Switches of the invention may be formed by a multi-level process for constructing hinge type RF MEMS switches, as represented in FIGS. 5A–5K, including initial steps in FIGS. 5A through 5D to form a photovoltaic diodes. Preferably, the temperatures for the MEM fabrication process in FIGS. 5E–5K are controlled to be not higher than 300 degrees centigrade (C.), to allow the integration compatibility of the current MMIC process. FIG. 5A shows the preparation of a p-n junction. In FIG. 5B, the p-type region is defined by a mesa etch and a metal contact 33*a* to the diode structure 33 is formed. An n-type deposit is made in FIG. 5C. Then, the diode structure 33 is isolated by etching away n-type material away from other parts of the substrate, as shown in FIG. 5D. The diode structure being completed allows interconnect metal to be formed. First, in FIG. 5E coplanar waveguides, i.e., ground planes 12 and signal lines 16, are defined as first layer of metal 34, for example gold, is evaporated on the coplanar waveguides. In FIG. 5F a thin dielectric layer 36 is deposited and VIA holes 38 are opened.

Figure 5G:
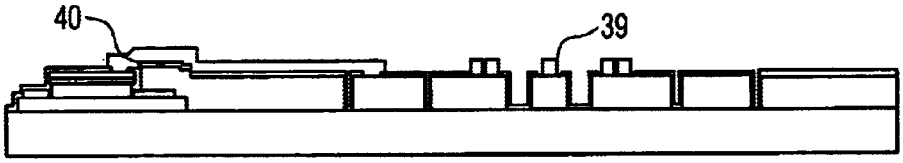
Figure 5H:
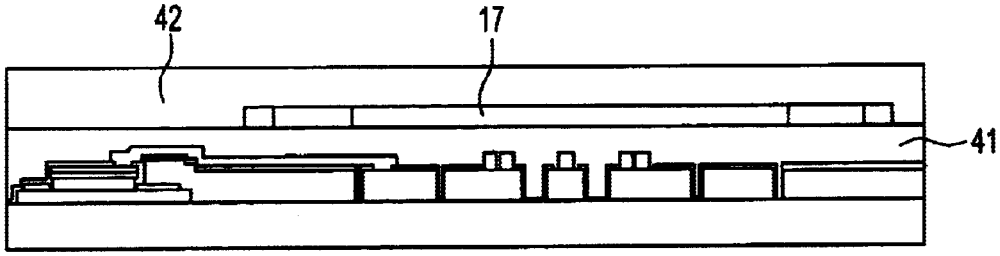
Figure 5I:
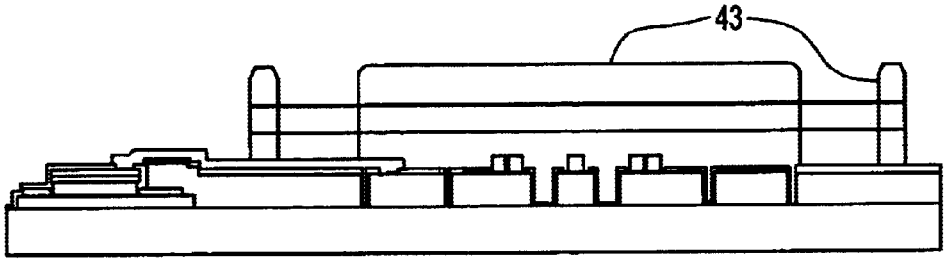
Figure 5J:
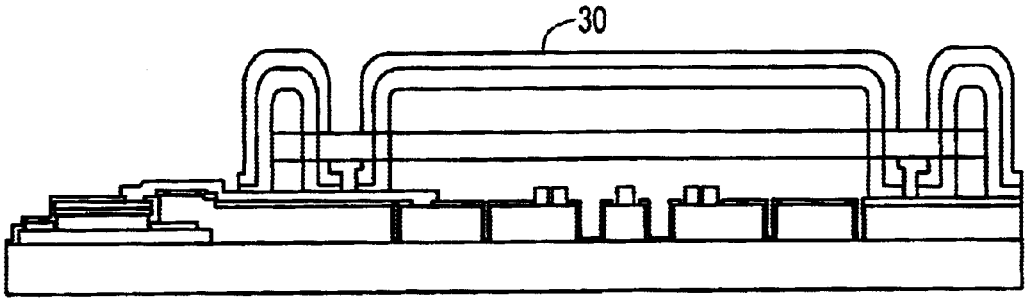
Figure 5K:
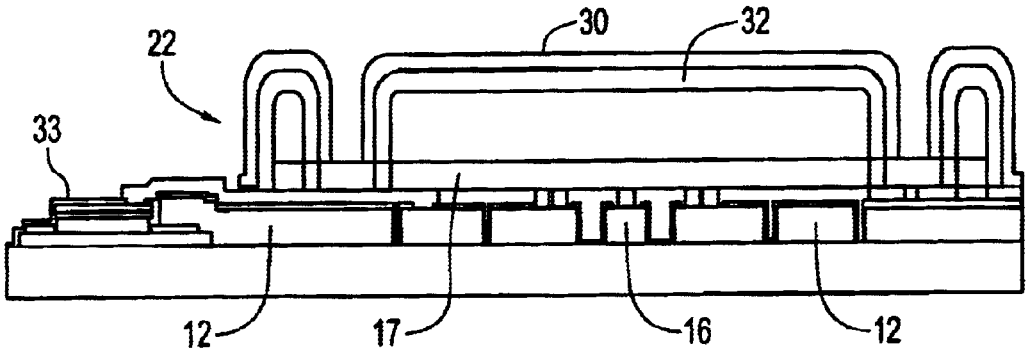

In FIG. 5G metal contact bumps 39 are formed in VIA holes 38 and a second layer of interconnect metal 40 is formed. A sacrificial layer 41 supports the metal pad 17 formed thereon in FIG. 5H, and a second sacrificial layer 42 is formed on the metal pad 17. The sacrificial layers 41, 42 are patterned with VIA holes 43 in FIG. 5J. This defines post areas 46 for the top electrodes 30 and for hinge structures that are formed in FIG. 5K. Sacrificial layers are etched away to release the whole structure of the present switch. Additional details concerning preferred processing parameters and materials are included in U.S. Pat. No. 6,134,997, which is incorporated by reference herein.

Figure 6B:
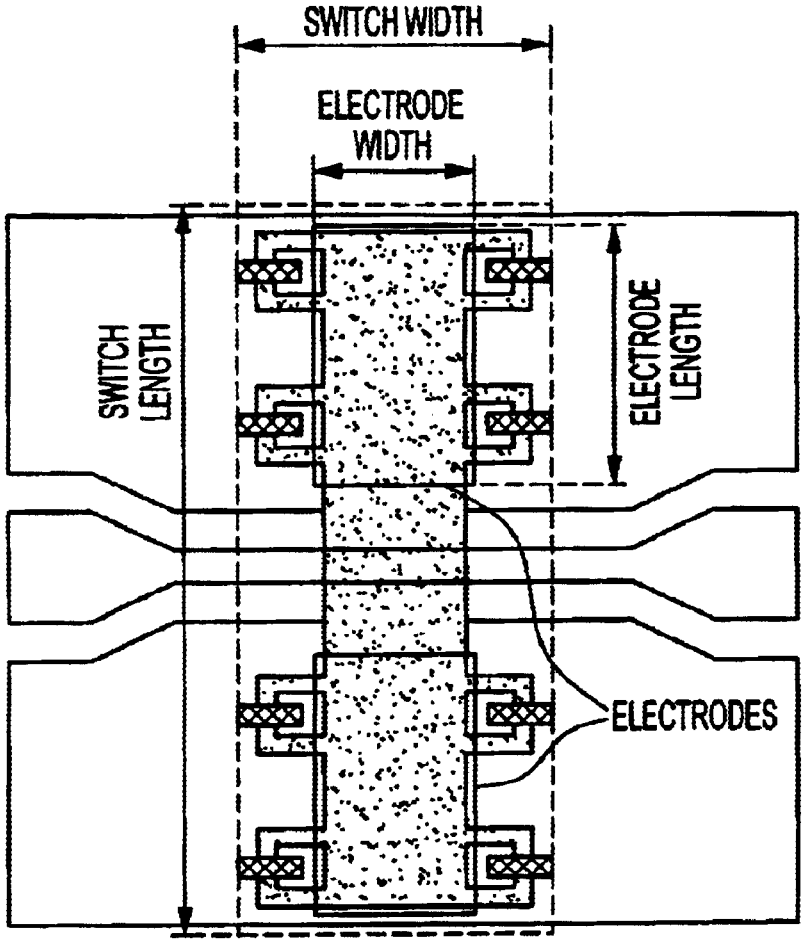
FIG. 6B is a schematic top view which identifies the dimensions shown in FIGS. 1, 6A.

Referring now to FIGS. 6A and 6B, various parameters are considered in the layout design which lead to the dimensions of the device. Artisans will appreciate that the device is not limited to a rectangular shape, but can be any geometry including a polygon, circle, or ellipse. Since the switch is designed for capacitive coupling operations as well as direct connections, the capacitance should be as large as possible to allow a switch down state. Thus, a contact area of the signal line 16 and metal pad 17 should be as large as possible to gain a wider operation bandwidth and lower impedance at high frequency regime.

A width of the metal pad 17 can overlap a width of the signal line 16. However, large overlap areas cause greater insertion loss in the switch up state. It is noted that coplanar waveguide characteristics with a signal line width of 20 $\mu$m, 50 $\mu$m, and 100 $\mu$m are viable (not shown). A width of the top electrodes 30 was chosen at 100 $\mu$M and 150 $\mu$m. Combined with the different coplanar waveguide structures, six different impedance sets are available.

Bottom electrodes 20 are inserted on the ground planes 12 of coplanar waveguides and are surrounded by the ground planes 12. A bigger electrode requires a lower actuation voltage. The ground plane 12 should be big enough to sustain 50 Ω impedance over the coplanar waveguides. Typically, a width of the ground plane is about 300 $\mu$m.

Referring now to FIG. 11, a table shows expectations for the present invention compared to known cantilever and membrane type switches. Of particular interest, note that a required switching voltage can be less than 3 Volts for the present invention, and 28 to 50 Volts for the known switches. This permits a relatively compact photovoltaic source to power a switching operation. Because of the low switching voltage, a large array of photovoltaic diodes is not required for operation of a switch. Accordingly, the electromagnetic energy, e.g., visible light, controlled switch of the invention will occupy a small chip area. The photovoltaic diode source may easily be integrated into a switch, and does not require an independent DC power source to operate. Thus, it should be understood that an improved switch has been shown and described.

From the foregoing description, it should be understood that an improved microelectromechanical switch has been shown and described which has many desirable attributes and advantages. It is adapted to switch the flow of a signal based on a relaxed or stimulated position of a metal pad. Unlike known prior art, a signal flow of the present switch is off when the metal pad makes a connection and on when the connection is breached. In addition, the present switch responds to a low actuation voltage of 3 Volts or less. The invention is also easy to manufacture.

Other alterations and modifications will be apparent to those skilled in the art. Accordingly, the scope of the invention is not limited to the specific embodiments used to illustrate the principles of the invention. Instead, the scope of the invention is properly determined by reference to the appended claims and any legal equivalents thereof.

What is claimed is:

1. A microelectromechanical switch that controls a flow of signals, the switch comprising:

a ground plane;

a signal line;

a conductive pad responsive to an actuation voltage for controlling the flow of signals in said signal line by selectively making and breaking electrical contact between said conductive pad and said ground and said signal line, without substantially deforming said conductive pad;

brackets to guide said conductive pad when said conductive pad makes and breaks electrical contact;

an electrode for attracting said conductive pad when said actuation voltage is applied to said electrode; and a photovoltaic source electrically connected to said electrode to supply said actuation voltage in response to electromagnetic energy.

2. The microelectromechanical switch according to claim 1, wherein said actuation voltage is 3 Volts or less.

3. The microelectromechanical switch according to claim 1, wherein said conductive pad further includes access holes for said brackets to fit through to keep said conductive pad properly aligned when making and breaking contact.

4. A microelectromechanical switch that controls a flow of signals, the switch comprising:

waveguides including a signal line and at least one ground plane;

a conductive pad responsive to an actuation voltage, said conductive pad electrically connecting said signal line and said ground plane when located in a relaxed position to send signals from said signal line to ground, and when actuated, allowing signals to flow through said signal line;

an electrode for attracting said conductive pad to said stimulated position when said actuation voltage is applied to said electrode;

brackets for guiding said conductive pad when said conductive pad moves between said relaxed position and a stimulated position due to said actuation voltage;

a photovoltaic source electrically connected to said electrode to supply said actuation voltage in response in response to electromagnetic energy.

5. The microelectromechanical switch according to claim 4, wherein said signal line includes an input port and an output port, the signal being grounded before reaching said output port when said conductive pad is in said relaxed position.

6. The microelectromechanical switch according to claim 4, further including a second electrode for attracting said conductive pad to said relaxed and position; and a second photovoltaic source for supplying an attractive voltage to said second electrode.

7. The microelectromechanical switch according to claim 6, further including dielectric suspensions to support said electrodes above said conductive pad and waveguides.

8. The microelectromechanical switch according to claim 6, wherein said second electrode is positioned between said conductive pad and said ground plane to enhance contact of said conductive pad to said ground plane and said signal line.

9. The microelectromechanical switch according to claim 4, wherein said actuation voltage is less than or equal to 3 Volts.

10. The microelectromechanical switch according to claim 4, further including a dielectric layer positioned on said signal line.

11. The microelectromechanical switch according to claim 4, wherein said electrical connection is a capacitive connection.

12. The microelectromechanical switch according to claim 4, wherein said electrical connection is a physical short circuit.

13. The microelectromechanical switch according to claim 5, wherein said input port is electrically connected to said output port by separating said conductive pad from said signal line.

14. A microelectromechanical switch that controls a flow of signals, the switch comprising:

a substrate base;

a ground plane formed on said substrate base;

a signal line formed on said substrate base;

a set of brackets on said substrate base;

a conductive pad moveably positioned within said brackets to contact both of said signal line and ground plane when in a first position and to contact neither said signal line or said ground plane when in a second position;

a first electrode disposed to attract said conductive pad to said first position when a voltage is applied to said first electrode;

a second electrode disposed to attract said conductive pad to said second position when a voltage is applied to said first electrode;

a first set of photovoltaic diodes disposed on said substrate and in electrical contact with said first electrode; and a second set of photovoltaic diodes disposed on said substrate in electrical contact with said second electrode.

* * * * *

UNITED STATES PATENT AND TRADEMARK OFFICE

CERTIFICATE OF CORRECTION

PATENT NO. : 6,717,496 B2
DATED : April 6, 2004
INVENTOR(S) : Feng et al.

It is certified that error appears in the above-identified patent and that said Letters Patent is hereby corrected as shown below:

Title page,
Item [75], Inventors address, delete "Urbana" and insert -- Champaign -- therefore.

Column 1,
Line 16, delete "fights" and insert -- rights -- therefore.

Column 2,
Line 31, delete "FIGS. 1, 6A" and insert -- FIG. 6A -- therefore.

Signed and Sealed this

Thirty-first Day of August, 2004

JON W. DUDAS
*Director of the United States Patent and Trademark Office*